US008369734B2

(12) United States Patent
Shimizu et al.

(10) Patent No.: US 8,369,734 B2
(45) Date of Patent: Feb. 5, 2013

(54) IMAGE FORMING APPARATUS AND IMAGE FORMING UNIT

(75) Inventors: Takashi Shimizu, Nagoya (JP); Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 395 days.

(21) Appl. No.: 12/645,510

(22) Filed: Dec. 23, 2009

(65) Prior Publication Data

US 2010/0166456 A1 Jul. 1, 2010

(30) Foreign Application Priority Data

Dec. 26, 2008 (JP) ..... 2008-333834

(51) Int. Cl.
*G03G 15/02* (2006.01)

(52) U.S. Cl. ..... 399/100; 399/114; 399/115; 399/172

(58) Field of Classification Search ..... 399/100, 399/113, 114, 172
See application file for complete search history.

(56) References Cited

U.S. PATENT DOCUMENTS

| | | | | |
|---|---|---|---|---|
| 4,566,777 | A * | 1/1986 | Honda et al. | 399/100 |
| 5,612,768 | A * | 3/1997 | Kim et al. | 399/92 |
| 2004/0013443 | A1 * | 1/2004 | Itoh et al. | 399/100 |
| 2007/0036577 | A1 | 2/2007 | Okabe et al. | |

FOREIGN PATENT DOCUMENTS

| | | |
|---|---|---|
| JP | H03-26150 U | 3/1991 |
| JP | 2001-154463 | 6/2001 |
| JP | 2005-092001 | 4/2005 |
| JP | 2007-072420 | 3/2007 |

OTHER PUBLICATIONS

Notification of Reason for Refusal for Japanese Patent Application No. 2008-333834 mailed Oct. 5, 2010.

* cited by examiner

*Primary Examiner* — Walter L Lindsay, Jr.
*Assistant Examiner* — Benjamin Schmitt
(74) *Attorney, Agent, or Firm* — Banner & Witcoff, Ltd.

(57) ABSTRACT

An image forming apparatus comprises a photosensitive drum, a charged wire which extends in a shaft direction of the photosensitive drum and charges the photosensitive drum by electric discharge, a frame disposed so as to surround the charged wire, the frame in which a cover side opening is formed in the side opposite to the photosensitive drum with respect to the charged wire, and a cover member disposed so as to cover the cover side opening while forming a blow path in communication with the cover side opening between the frame and the cover member. The cover member moves along the charged wire and is constructed detachably from a side surface of the frame and also a cleaning member for cleaning the charged wire is disposed.

15 Claims, 5 Drawing Sheets

IMAGE FORMING APPARATUS AND IMAGE FORMING UNIT

CROSS REFERENCE TO RELATED APPLICATION

The present application claims priority from Japanese Patent Application No. 2008-333834 filed on Dec. 26, 2008, the disclosure of which is incorporated herein by reference in its entirety.

BACKGROUND OF THE INVENTION

The present invention relates to an image forming apparatus and an image forming unit.

Generally, as an image forming apparatus of an electrophotography method, an apparatus in which a unit having a charged wire for charging a photosensitive body by electric discharge is detachably attached to an apparatus body is known. A configuration in which a blow hole along a charged wire is formed in a frame body surrounding the charged wire in a unit and an opening and closing lid part for covering the blow hole while forming blow space in communication with the blow hole between the frame body and the lid part is disposed is known in the related art.

Also, this unit has a wire cleaner for cleaning a charged wire by making sliding contact with the charged wire, and an operation part capable of operating along the blow hole is formed in this wire cleaner.

According to such a configuration, air can efficiently be blown into the charged wire, so that adhesion of a foreign substance to the charged wire can be suppressed.

SUMMARY OF THE INVENTION

By the way, in the related image forming apparatus, when a charged wire is cleaned by a wire cleaner, a unit receiving part is detached from an apparatus body and an opening and closing lid part is opened and then it is necessary to operate the wire cleaner, so that there was a problem in operability.

Therefore, an object of the invention is to provide an image forming apparatus and an image forming unit capable of improving operability at the time of cleaning an electric discharge member while efficiently suppressing adhesion of a foreign substance to the electric discharge member.

To solve the problem, an image forming apparatus according to the exemplary embodiment of the present invention comprises:

a photosensitive body;

an electric discharge member which extends in a shaft direction of the photosensitive body and electrically charges the photosensitive body by electric discharge;

a frame disposed so as to surround the electric discharge member, an opening being formed at a side of the frame opposite to the photosensitive body with respect to the electric discharge member; and a cover member which is disposed so as to cover the opening and forms a blow path in communication with the opening between the frame and the cover member, wherein the cover member includes a cleaning member for cleaning the electric discharge member, the cleaning member being movable along the electric discharge member and being formed detachably from a side surface of the frame.

Further, an image forming unit according to the exemplary embodiment of the present invention comprises:

an image forming apparatus body;

plural process units, each of the plurality process units including:

a photosensitive body;

an electric discharge member which extends in a shaft direction of the photosensitive body and electrically charges the photosensitive body by electric discharge;

a frame disposed so as to surround the electric discharge member, an opening being formed at a side of the frame opposite to the photosensitive body with respect to the electric discharge member; and a cover member which is disposed so as to cover the opening and forms a blow path in communication with the opening between the frame and the cover member; and a support member which supports the plural process units in a state of arranging the process units side by side and is detachably attached to the image forming apparatus body, wherein the cover member includes a cleaning member for cleaning the electric discharge member, the cleaning member being movable along the electric discharge member and being formed extractably from a side surface of the frame.

DESCRIPTION OF EXEMPLARY EMBODIMENTS

<Outline Configuration of Color Printer>

Figure 1:
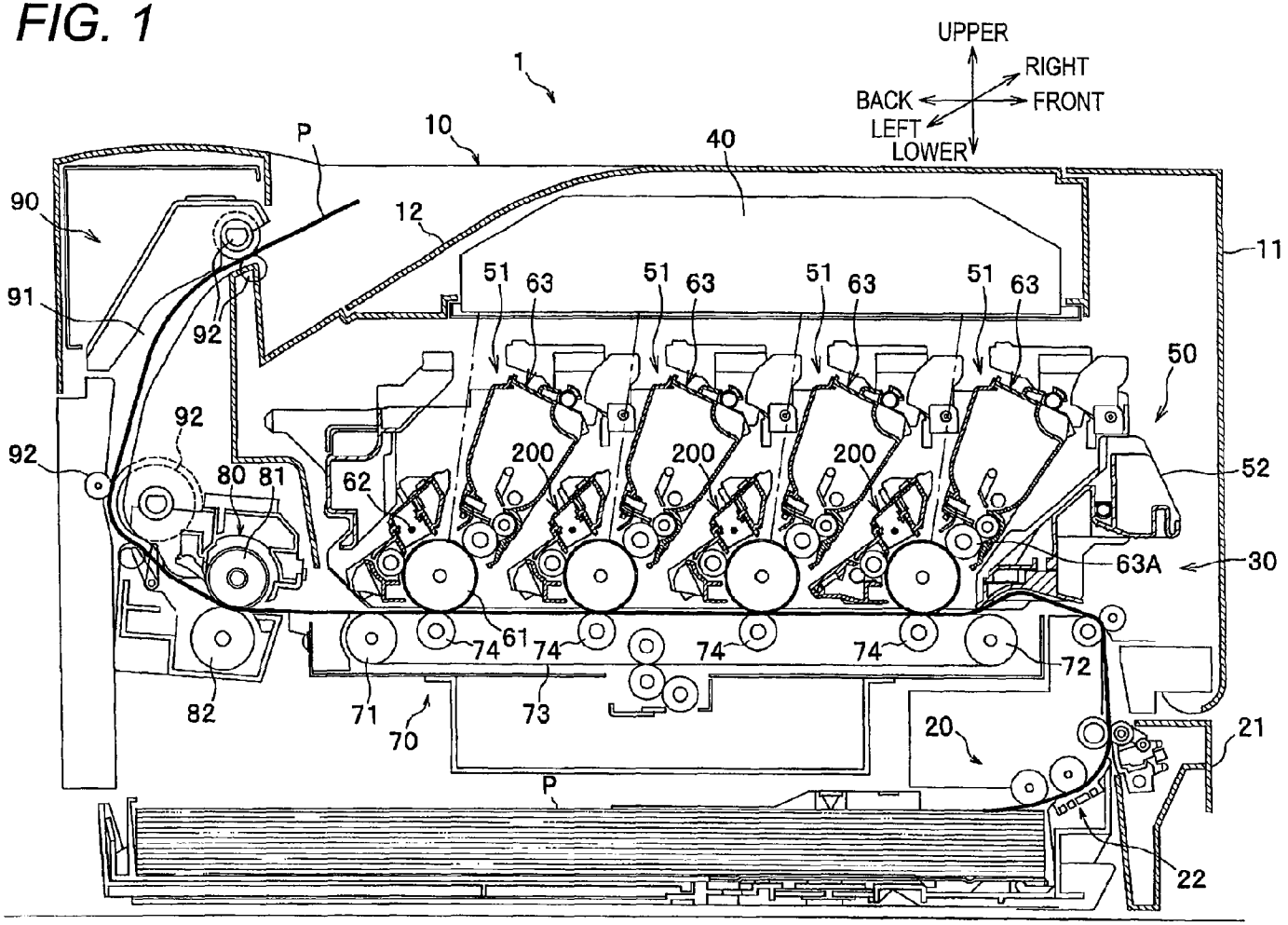
FIG. 1 is a sectional view showing an outline configuration of a color printer as one example of an image forming apparatus.

Next, an embodiment of the invention will properly be described in detail with reference to the drawings. In the reference drawings, FIG. 1 is a sectional view showing an outline configuration of a color printer as one example of an image forming apparatus. In addition, in the following description, directions are described by directions based on a user using the color printer. That is, the right side in FIG. 1 is set in the "front", and the left side is set in the "back", and the front side is set in the "left", and the back side is set in the "right". Upper and lower directions in FIG. 1 are set in the "upper and lower".

As shown in FIG. 1, a color printer 1 comprises a sheet feeding part 20 for feeding a sheet P, an image forming part 30 for forming an image on the fed sheet P, and a sheet discharging part 90 for discharging the sheet P on which the image is formed inside a body cabinet 10 as one example of an apparatus body.

The sheet feeding part 20 is disposed in the lower portion of the inside of the body cabinet 10, and mainly comprises a sheet feeding tray 21 for receiving a sheet P, and a sheet feeding mechanism 22 for feeding the sheet P from the sheet feeding tray 21 to the image forming part 30. The sheets P of the inside of the sheet feeding tray 21 are separated one by one by the sheet feeding mechanism 22 and are fed to the image forming part 30.

The image forming part 30 is mainly constructed of an exposure unit 40, an image forming unit 50, a transfer unit 70, and a fixing unit 80.

The exposure unit 40 is disposed in the upper portion of the inside of the body cabinet 10, and comprises a laser light emitting part, a polygon mirror, a lens, a reflecting mirror (not shown), etc. Laser light emitted from the laser light emitting part in correspondence with each color of cyan, magenta, yellow and black is reflected by the polygon mirror or the reflecting mirror and passes through the lens and is applied to a surface of each of the photosensitive drums 61 by high-speed scanning.

The image forming unit 50 is arranged between the sheet feeding part 20 and the exposure unit 40, and mainly comprises four process units 51, and a support member 52 for supporting the four process units 51 in a state of arranging the process units side by side (backward and forward). A detailed configuration of the image forming unit 50 will be described below.

The process unit 51 mainly comprises the photosensitive drum 61 as one example of a photosensitive body, a charged wire 62 as one example of an electric discharge member, and a developing cartridge 63. The developing cartridge 63 mainly comprises a developing roller 63A as one example of a developer carrier, a supply roller, a layer thickness regulating blade and a toner receiving part shown by omitting numerals.

The transfer unit 70 is disposed between the sheet feeding part 20 and the image forming unit 50, and mainly comprises a driving roller 71, a driven roller 72, an endless-shaped conveying belt 73 tensed between the driving roller 71 and the driven roller 72, and four transfer rollers 74. In the conveying belt 73, the outside surface is in contact with each of the photosensitive drums 61 and each of the transfer rollers 74 is arranged in the inside so as to pinch the conveying belt 73 between each of the photosensitive drums 61 and each of the transfer rollers 74.

The fixing unit 80 is disposed in the back portion of the transfer unit 70 and the image forming unit 50, and comprises a heating roller 81, and a pressurizing roller 82 which is arranged as opposed to the heating roller 81 and presses the heating roller 81.

In the image forming part 30, an electrostatic latent image is formed on the photosensitive drum 61 by exposing a surface of the photosensitive drum 61 by high-speed scanning of laser light from the exposure unit 40 after the surface of the photosensitive drum 61 is uniformly charged by corona electric discharge of the charged wire 62. Toner of the inside of the toner receiving part is supplied to the developing roller 63A through the supply roller, and enters between the developing roller 63A and the layer thickness regulating blade and is carried on the developing roller 63A as a thin layer with a constant thickness.

The toner carried on the developing roller 63A is supplied from the developing roller 63A to the electrostatic latent image on the photosensitive drum 61. Consequently, the electrostatic latent image is imaged and a toner image is formed on the photosensitive drum 61. Thereafter, the toner image formed on each of the photosensitive drums 61 is sequentially superimposed on a sheet P and is transferred by conveying the sheet P supplied on the conveying belt 73 between the photosensitive drum 61 and the conveying belt 73 (transfer roller 74). Then, the toner image transferred to the sheet P is thermally fixed by conveying the sheet P between the heating roller 81 and the pressurizing roller 82.

The sheet discharging part 90 mainly comprises a sheet discharging path 91 formed so as to extend upward from an outlet of the fixing unit 80 and change the direction forward, and plural conveying rollers 92 for conveying a sheet P. The sheet P on which the toner image is thermally fixed is conveyed on the sheet discharging path 91 by the conveying rollers 92 and is discharged on a sheet discharging tray 12 disposed in the upper portion of the body cabinet 10.

<Detailed Configuration of Image Forming Unit>

Figure 2:
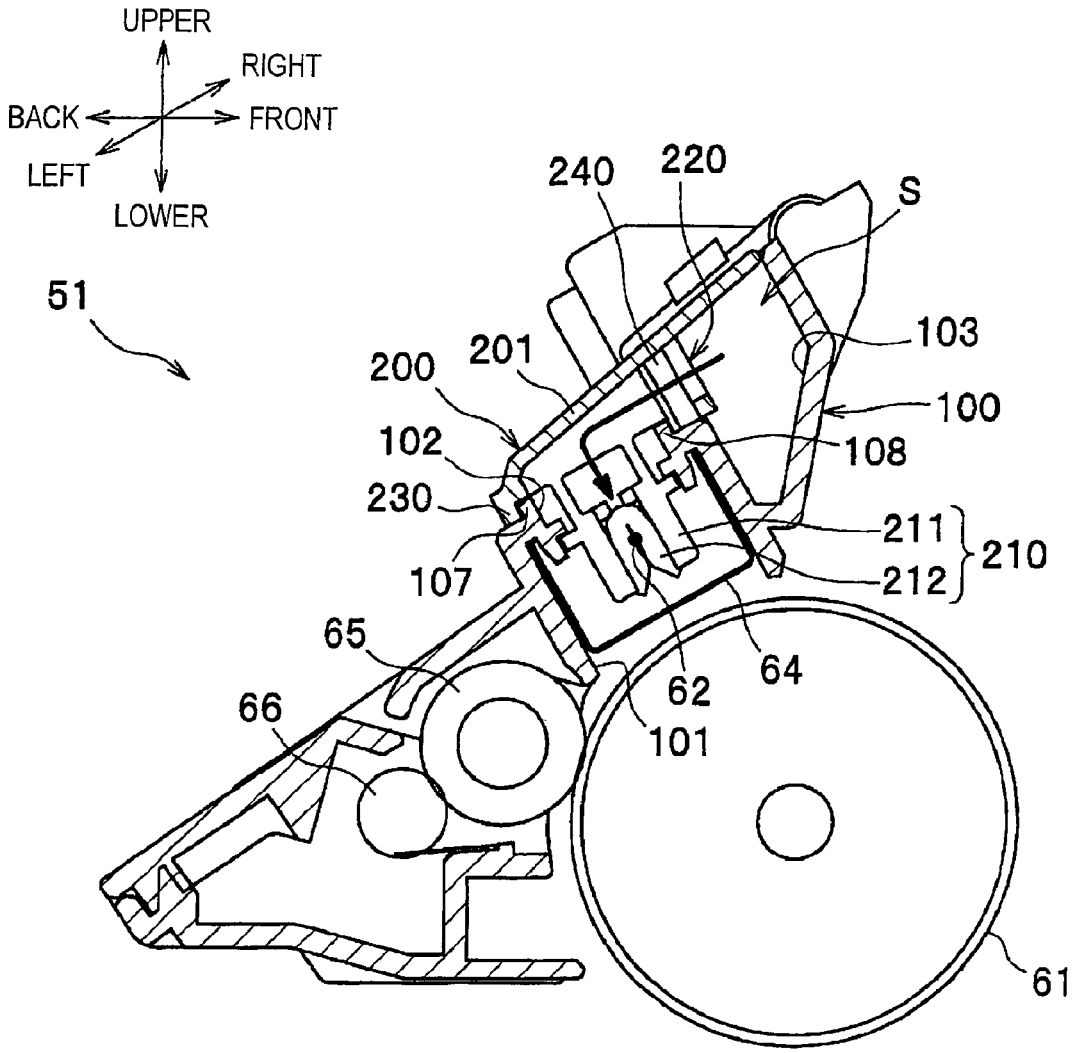
FIG. 2 is an enlarged view showing a configuration of a process unit.

Next, a detailed configuration of the image forming unit 50 will be described around a feature portion of the invention. FIG. 2 is an enlarged view showing a configuration of the process unit, and FIG. 3 is a perspective view of a cover member and a frame, and FIG. 4 is a perspective view in the case of viewing the image forming unit from the right side.

As described above, the image forming unit 50 mainly comprises the four process units 51, and the support member 52.

As shown in FIG. 2, the process unit 51 comprises the photosensitive drum 61, the charged wire 62, the developing cartridge 63 (see FIG. 1), a frame 100 for supporting the photosensitive drum 61 and the charged wire 62, and a cover member 200 for forming a blow path S between the frame 100 and the cover member.

Figure 3:
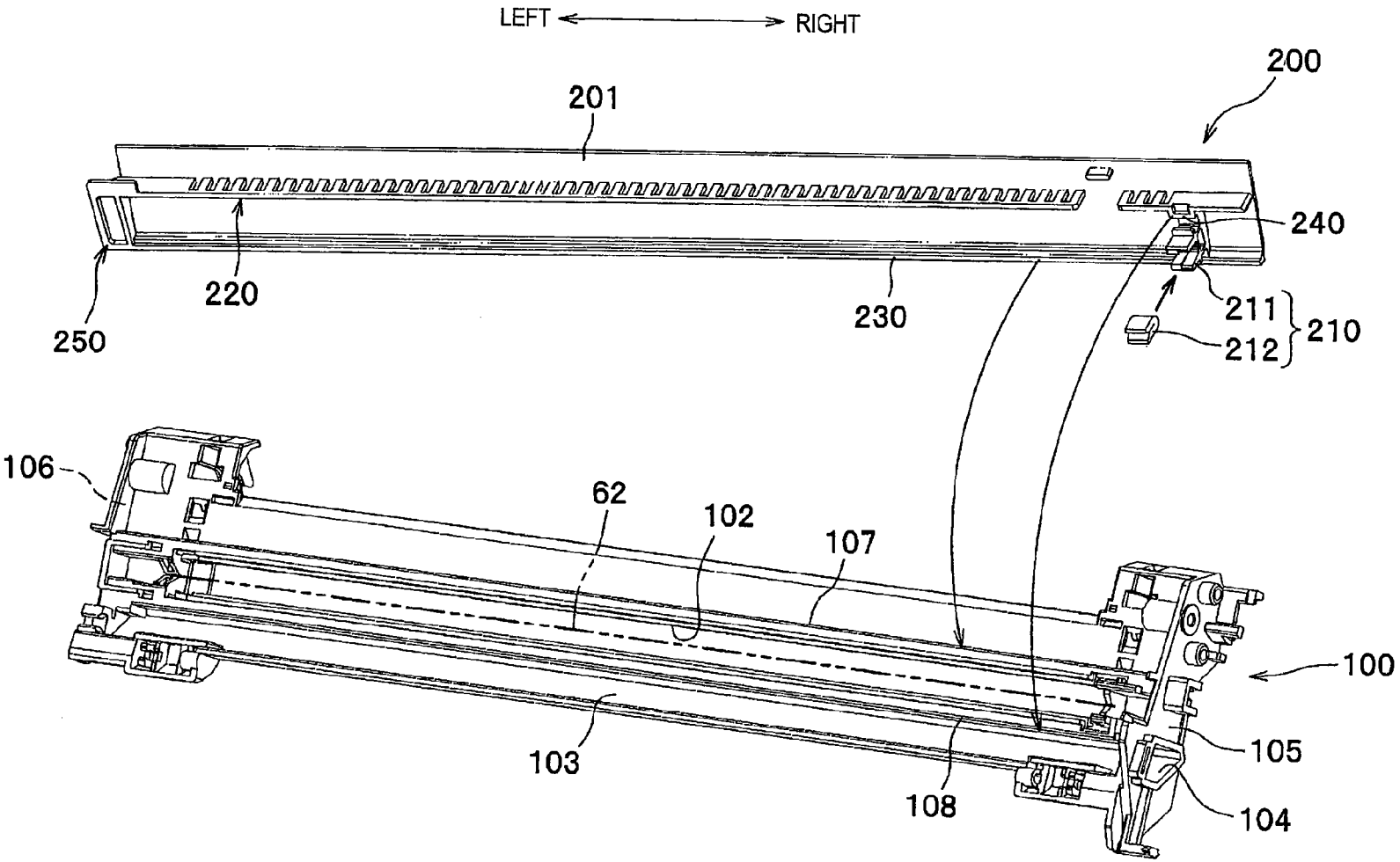
FIG. 3 is a perspective view of a cover member and a frame.
Figure 4:
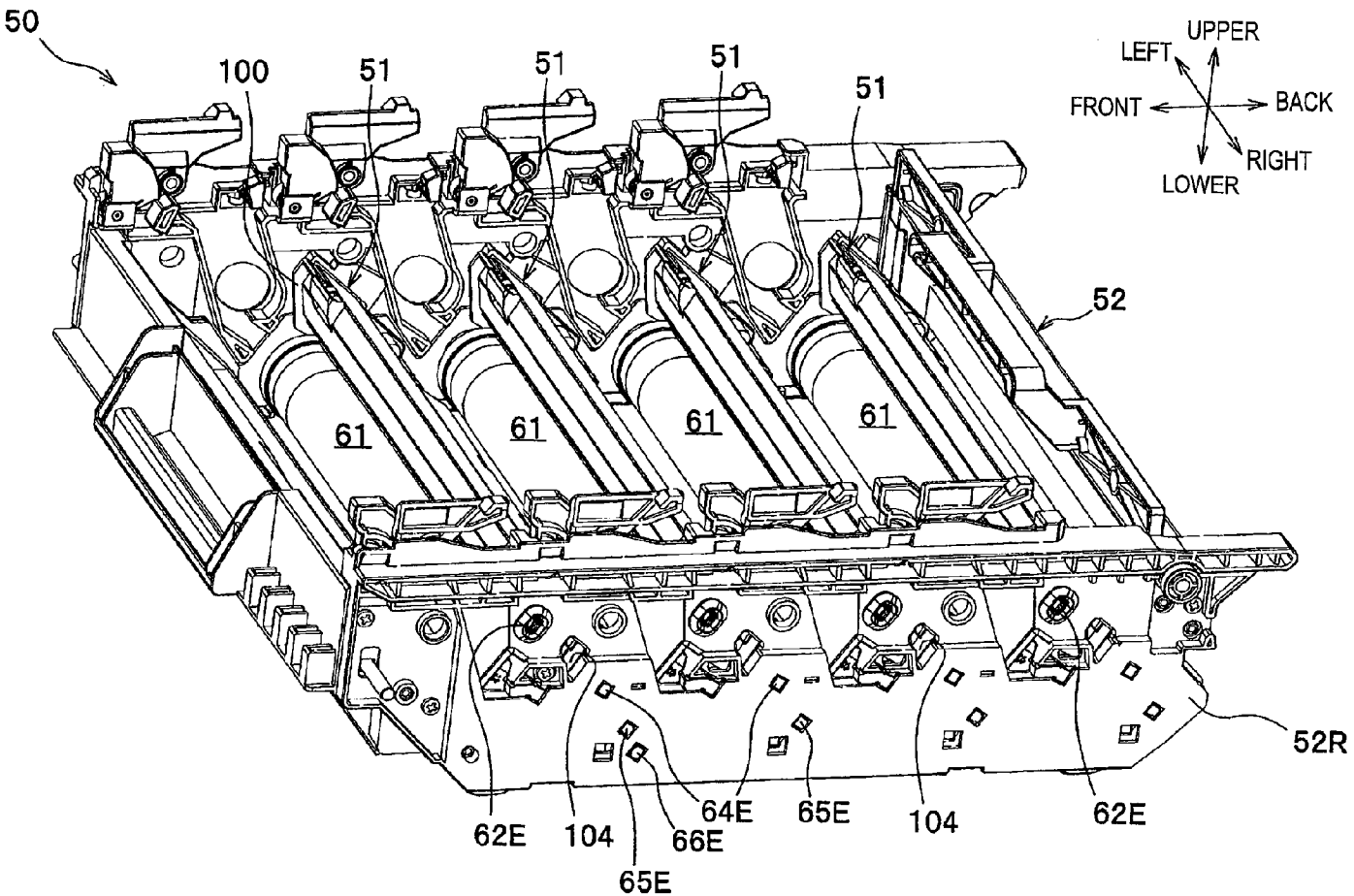
FIG. 4 is a perspective view in the case of viewing an image forming unit from the right side.

The charged wire 62 is tensed so as to long extend in a shaft direction (right and left directions) of the photosensitive drum 61 with respect to the frame 100 (see FIG. 3).

The developing cartridge 63 is constructed attachably to and detachably from the frame 100 (specifically, the support member 52). FIGS. 2 and 4 show a state of detaching the developing cartridge 63.

The frame 100 forms a frame body of the process unit 51 and rotatably supports the photosensitive drum 61 and is disposed so as to surround the charged wire 62. This frame 100 is constructed so that a drum side opening 101 is formed between the photosensitive drum 61 and the charged wire 62 and a cover side opening 102 is formed in the side opposite to the photosensitive drum 61 with respect to the charged wire 62 and air is enabled to flow in an arrow direction of FIG. 2.

As shown in FIGS. 2 and 3, in the frame 100, a recessed part 103 constructing a part of the blow path S is disposed in the front oblique upper portion of the charged wire 62 and a supply port 104 for supplying air to the blow path S in communication with the recessed part 103 (blow path S) is disposed in a right side surface 105. Here, the color printer 1 comprises a duct and a blow fan (not shown), and the duct communicates to the supply port 104 of each of the process units 51. Air blown into the duct by the blow fan is supplied to the inside of the blow path S through the supply port 104.

As shown in FIG. 4, a wire electrode 62E (electrode) for applying a voltage to the charged wire 62 is disposed in the right side surface 105 of the frame 100 and is exposed to the outside from an opening formed in a right side surface 52R of the support member 52. In addition, the process unit 51 comprises a grid 64, a cleaning roller 65 for recovering toner remaining on the photosensitive drum 61, and a recovering roller 66 (only the process unit 51 of the most front) for recovering toner from the cleaning roller 65 (see FIG. 2). Then, a grid electrode 64E, a cleaning roller electrode 65E and a recovering roller electrode 66E for applying a voltage to these grid and rollers are disposed in the right side surface 105 of the frame 100 and are exposed to the outside from openings of the support member 52.

Further, as shown in FIGS. 2 and 3, a pair of frame side guide parts 107, 108 for slidably guiding the cover member 200 in right and left directions are disposed in the frame 100. The frame side guide parts 107, 108 extend in a longitudinal direction (right and left directions) of the charged wire 62 so as to interpose the cover side opening 102 therebetween.

The cover member 200 is a member which is formed from a resin and forms the blow path S in communication with the cover side opening 102 between the frame 100 and the cover member 200 and covers the cover side opening 102. In this cover member 200, a cleaning member 210, a rectifying member 220, a back guide part 230 and a front guide part 240 as one example of a pair of cover side guide parts, and an operation part 250 are disposed on a plate-shaped cover body 201.

The cleaning member 210 is a member for cleaning the charged wire 62, and is constructed of a cleaner support part 211 and a wire cleaner 212 for making sliding contact with the charged wire 62 and wiping a foreign substance adhering to the charged wire 62. The cleaner support part 211 is formed so as to protrude toward the side of the charged wire 62 in the right end side of the cover body 201 and the side opposite to the blow path S with respect to the rectifying member 220. The top of this cleaner support part 211 is formed in a U shape in sectional view, and the wire cleaner 212 is folded in a U shape and is attached to the recessed portion.

The rectifying member 220 is a member for rectifying air flowing from the blow path S toward the charged wire 62. This rectifying member 220 extends in right and left directions and is formed in a wall shape in which the blow path S and the cover side opening 102 are partitioned, and slits are disposed at equal distances in the right and left directions. By disposing such a rectifying member 220, air can be equally supplied in substantially the whole length of the charged wire 62, so that air ionized by the charged wire 62 can be equally supplied to a surface of the photosensitive drum 61. Consequently, the surface of the photosensitive drum 61 can be charged uniformly, with the result that image quality can be improved.

The back guide part 230 and the front guide part 240 are parts capable of sliding the cover member 200 along the charged wire 62 in the right and left directions by slidably engaging with the frame side guide parts 107, 108. The back guide part 230 and the front guide part 240 are arranged backward and forward with the cleaning member 210 being interposed therebetween.

The back guide part 230 is formed so as to extend over substantially the whole length of the cover body 201 in the right and left directions in the back end of the cover body 201. The front guide part 240 is formed so as to extend over a range shorter than the back guide part 230 in the right and left directions in the side of the cover side opening 102 near to the right end of the rectifying member 220. Concretely, the front guide part 240 extends over a range opposed to the cleaning member 210. In addition, the cleaner support part 211 of the cleaning member 210 is formed so as to join its proximal end to the back guide part 230 and the front guide part 240.

By such a configuration, the whole sliding resistance at the time of moving the cover member 200 can be reduced, so that the cover member 200 can be moved well. The rectifying member 220 (slits) can be disposed over substantially the whole length of the charged wire 62, so that image quality can be improved by action of the rectifying member 220. Further, the periphery of the cleaning member 210 (cleaner support part 211) can be reinforced by sandwiching and disposing the cleaning member 210.

The operation part 250 is a part operated at the time of moving the cover member 200, and is disposed in the left end side of the cover body 201 opposite to the side (right side surface 105) in which each of the electrodes such as the wire electrode 62E or the supply port 104 is disposed. By disposing the operation part 250 in the side opposite to the supply port 104 thus, the supply port 104 can be increased while forming the operation part 250 in a simple configuration, and turbulence of a flow of air of the inside of the blow path S can be suppressed. By disposing the operation part 250 in the side opposite to each of the electrodes such as the wire electrode 62E, a situation in which a user touches the electrode by mistake at the time of operating the operation part 250 can be suppressed and occurrence of poor contact with the electrode of the apparatus body side by rust, dirt, etc. of the electrode can be suppressed.

Figures 5A, 5B:
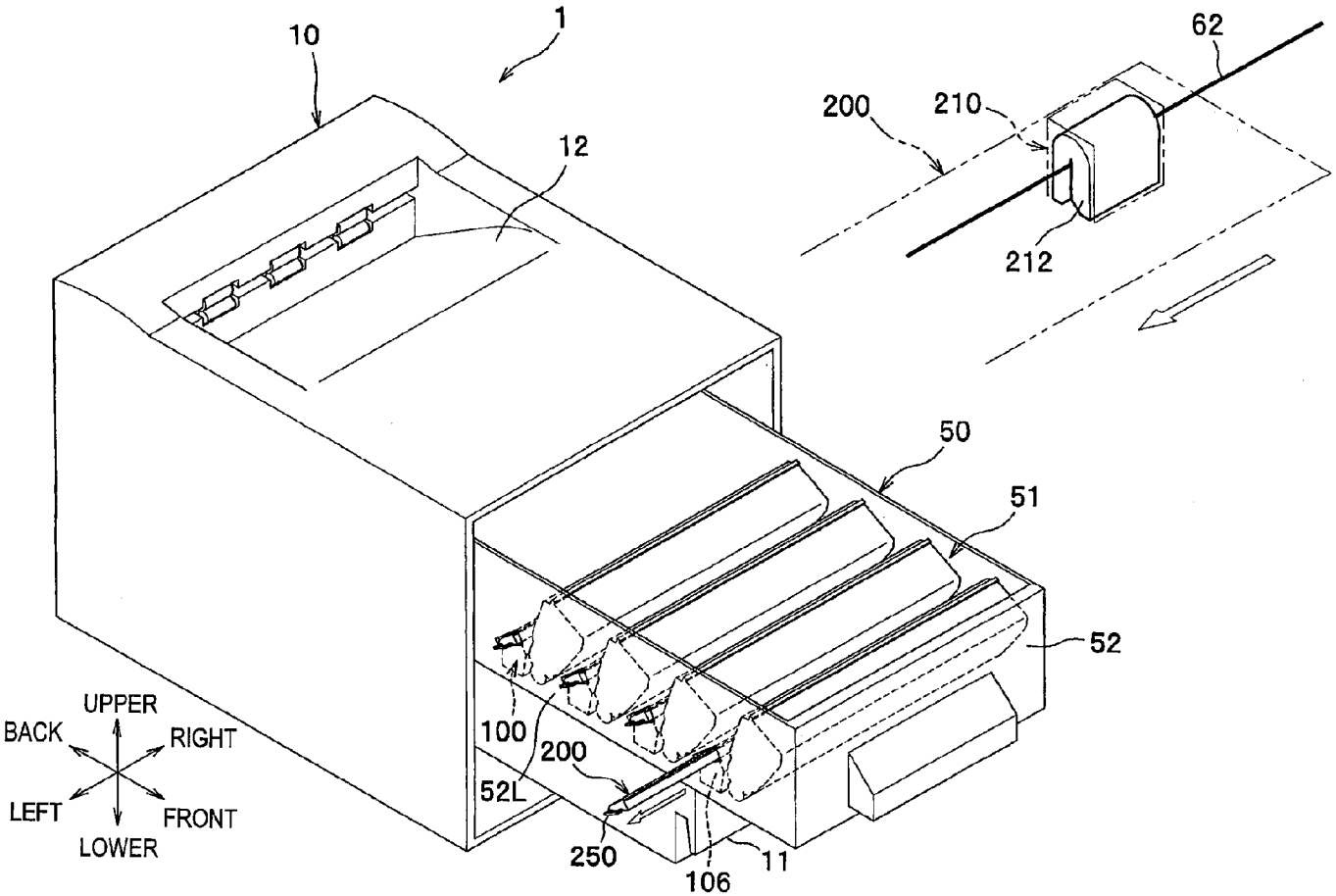
FIG. 5A is a schematic diagram showing a situation in which the cover member is extracted from a side surface of the frame.
FIG. 5B is a schematic diagram showing a situation in which a charged wire is cleaned by extraction of the cover member.

As shown in FIG. 4, the support member 52 is formed in substantially a box shape in which the upper portion is opened, and has a configuration (an extractable configuration) of being attached detachably from the body cabinet 10 from an opening formed at the time of opening a front cover 11 disposed in the body cabinet 10 (see FIGS. 5A and 5B). The four process units 51 are arranged side by side in the support member 52. Concretely, as shown in FIG. 1, the cover member 200 of one process unit 51 of the adjacent process units 51 is arranged so as to be covered with the other process unit 51 (specifically, the developing cartridge 63).

Action and effect of the color printer 1 (image forming unit 50) constructed as mentioned above will be described. FIG. 5A is a schematic diagram showing a situation in which a cover member is extracted from a side surface of a frame, and FIG. 5B is a schematic diagram showing a situation in which a charged wire is cleaned by extraction of the cover member.

As shown in FIG. 5A, in the case of cleaning the charged wire 62, the front cover 11 is first opened and the image forming unit 50 (support member 52) is extracted forward. Then, the operation part 250 exposed to the outside from an opening formed in a left side surface 52L of the support member 52 is grasped and is pulled leftward and thereby, the cover member 200 is extracted from a left side surface 106 of the frame 100. Consequently, as shown in FIG. 5B, the cleaning member 210 disposed in the right end side of the cover member 200 moves leftward along the charged wire 62 together with the cover member 200, so that a foreign substance adhering to the charged wire 62 can be wiped by the wire cleaner 212. Cleaning of the charged wire 62 is also done in the case of pushing the extracted cover member 200 rightward and returning the cover member to an initial position.

According to the color printer 1 (image forming unit 50) of the embodiment thus, the cover member 200 in which the cleaning member 210 is disposed moves along the charged wire 62 and is constructed extractably from the left side surface 106 of the frame 100, so that the cleaning member 210 can be moved along the charged wire 62 by extracting the cover member 200. Consequently, by extracting the cover member 200, the charged wire 62 can be cleaned by the wire cleaner 212, so that operability at the time of cleaning the charged wire 62 can be improved as compared with a conventional configuration.

The cleaning member 210 is disposed in the cover member 200 for forming the blow path S between the frame 100 and the cover member and is constructed extractably and thereby, it becomes unnecessary to dispose a dedicated member for moving the cleaning member 210 along the charged wire 62, so that the blow path S can be ensured sufficiently. Consequently, a configuration can be simplified and air is well blown into the charged wire 62, so that adhesion of a foreign substance to the charged wire 62 can be suppressed to a minimum.

The invention can easily clean the charged wire 62 without detaching the developing cartridge 63 even in a configuration in which the cover member 200 of one process unit 51 of the adjacent process units 51 is arranged so as to be covered with the other process unit 51 (the developing cartridge 63) and there is little space for operating the cover member 200.

The invention can easily clean the charged wire 62 even in a configuration in which the support member 52 for supporting the plural process units 51 in a state of arranging the process units side by side is provided and there is little space for operating the cover member 200. Further, a gap between the adjacent process units 51 can be reduced by applying the invention, so that the image forming unit 50 or the color printer 1 can be miniaturized.

The embodiment of the invention has been described above, but the invention is not limited to the embodiment described above. In a concrete configuration, changes can be made properly without departing from the gist of the invention.

In the embodiment described above, the charged wire 62 is illustrated as an electric discharge member, but the invention is not limited to this and, for example, an electric discharge member which lines needle-shaped electrodes in a row and performs electric discharge by the tops of the needle-shaped electrodes may be adopted.

In the embodiment described above, the frame 100 for forming a frame body of the process unit 51 is illustrated as a frame, but the invention is not limited to this and, for example, a frame of a charger disposed in a process unit may be adopted.

In the embodiment described above, the example of constructing the cover member 200 extractably from the left side surface 106 of the frame 100 is shown, but the invention is not limited to this, and the cover member 200 may be constructed extractably from the right side surface 105 of the frame 100.

In the embodiment described above, the example comprising the support member 52 which supports the four process units 51 in a state of arranging the process units side by side and is constructed extractably from the body cabinet 10 is shown, but the invention is not limited to this. For example, a configuration in which each of the process units 51 is directly supported in the body cabinet 10 without comprising the support member 52 may be adopted. In this case, the charged wire 62 can be cleaned by disposing an openable and closable cover in a side surface of the body cabinet 10 and opening this cover and operating the cover member 200.

In the embodiment described above, the color printer 1 is illustrated as an image forming apparatus, but the invention is not limited to this and, for example, a monochrome printer, a copy machine or a complex machine may be adopted. In the embodiment described above, the photosensitive drum 61 is illustrated as a photosensitive body, but the invention is not limited to this and, for example, a photosensitive belt may be adopted.

What is claimed is:

1. An image forming apparatus comprising:

an image forming apparatus body;

a process unit including:

a photosensitive body;

an electric discharge member which extends in a shaft direction of the photosensitive body and configured to electrically charge the photosensitive body by electric discharge;

a frame disposed so as to surround the electric discharge member, an opening being formed at a side of the frame opposite to the photosensitive body with respect to the electric discharge member, the frame including a pair of side surfaces opposed to each other in the shaft direction; and a cover member which is disposed so as to cover the opening and forms a blow path in communication with the opening between the frame and the cover member; and a support member which supports the process unit and is detachably attached to the image forming apparatus body, wherein the cover member includes a cleaning member configured to clean the electric discharge member, the cleaning member being movable along the electric discharge member and being formed to be detachable from one of the side surfaces of the frame, and wherein the support member includes a support side surface having a support member opening through which the cover member is to be detached.

2. The image forming apparatus according to claim 1 further comprising:

a plurality of process units, each of which includes a respective photosensitive body, a respective electric discharge member and a respective cover member, arranged side by side, wherein the plurality of process units are arranged so that the respective cover member of one process unit is covered with an adjacent other process unit.

3. The image forming apparatus according to claim 2, further comprising a support member which supports the plural process units in a state of arranging the process units side by side and is formed detachably from an apparatus body.

4. The image forming apparatus according to claim 1, further comprising:

a plurality of process units, each of which includes a respective photosensitive body, a respective electric discharge member, a respective frame, a respective cover member and a respective detachable developing cartridge having a developer carrier, the plurality of process units being arranged side by side, wherein the plural process units are arranged so that the respective cover member of one process unit of the plurality of process units is covered with the developing cartridge of an adjacent other process unit.

5. The image forming apparatus according to claim 1, wherein a rectifying member, which extends in a longitudinal direction of the electric discharge member and is configured to rectify air flowing from the blow path toward the electric discharge member, is disposed in the cover member.

6. The image forming apparatus according to claim 1, wherein an operation part operated at a time of detachment is disposed in the cover member, and the frame is provided with a supply port, for supplying air to the blow path, at a side surface opposite to a side at which the operation part is disposed.

7. The image forming apparatus according to claim 1, wherein an operation part operated at a time of detachment is disposed in the cover member, and the frame is provided with an electrode, for applying a voltage to the electric discharge member, at a side surface opposite to a side at which the operation part is disposed.

8. The image forming apparatus according to claim 1, wherein a pair of frame side guide parts, which extend in a longitudinal direction of the electric discharge member and are configured to movably guide the cover member, are disposed in the frame and in the cover member, a pair of cover side guide parts configured to slidably engage with the frame side guide parts are disposed with the cleaning member being interposed therebetween, and one of the pair of cover side guide parts is formed so as to extend in a longitudinal direction of the electric discharge member and the other one of the pair of cover side guide parts is formed so as to extend over a range shorter than the one of the pair of cover side guide parts.

9. An image forming unit comprising:

an image forming apparatus body;

plural process units, each of the plurality process units including:

a photosensitive body;

an electric discharge member which extends in a shaft direction of the photosensitive body and electrically charges the photosensitive body by electric discharge;

a frame disposed so as to surround the electric discharge member, an opening being formed at a side of the frame opposite to the photosensitive body with respect to the electric discharge member, the frame including a pair of side surfaces opposed to each other in the shaft direction; and a cover member which is disposed so as to cover the opening and forms a blow path in communication with the opening between the frame and the cover member; and a support member which supports the plural process units in a state of arranging the process units side by side and is detachably attached to the image forming apparatus body, wherein the cover member includes a cleaning member for cleaning the electric discharge member, the cleaning member being movable along the electric discharge member and being formed detachably from one of the side surfaces of the frame, and wherein the support member includes a support side surface having a support member opening through which the cover member is to be detached.

10. The image forming unit according to claim 9, wherein the cover member of one process unit is arranged so as to be covered with an adjacent other process unit.

11. The image forming unit according to claim 9, wherein each of the process units includes a respective detachable developing cartridge having a developer carrier, and the cover member of one process unit is arranged so as to be covered with the respective developing cartridge of an adjacent other process unit.

12. The image forming unit according to claim 9, wherein a rectifying member, which extends in a longitudinal direction of the electric discharge member and is configured to rectify air flowing from the blow path toward the electric discharge member, is disposed in the cover member.

13. The image forming unit according to claim 9, wherein an operation part operated at a time of detachment is disposed in the cover member, and the frame is provided with a supply port, for supplying air to the blow path, at a side surface opposite to a side at which the operation part is disposed.

14. The image forming unit according to claim 9, wherein an operation part operated at a time of detachment is disposed in the cover member, and the frame is provided with an electrode, for applying a voltage to the electric discharge member, at a side surface opposite to a side at which the operation part is disposed.

15. The image forming unit according to claim 9, wherein a pair of frame side guide parts, which extend in a longitudinal direction of the electric discharge member and are configured to movably guide the cover member, are disposed in the frame and in the cover member, a pair of cover side guide parts configured to slidably engage with the frame side guide parts are disposed with the cleaning member being interposed therebetween, and one of the pair of cover side guide parts is formed so as to extend in a longitudinal direction of the electric discharge member and the other one of the pair of cover side guide parts is formed so as to extend over a range shorter than the one of the pair of cover side guide parts.

* * * * *